United States Patent [19]

Lawrance

[11] Patent Number: 4,691,885

[45] Date of Patent: Sep. 8, 1987

[54] DISPLAY STAND

[76] Inventor: George F. Lawrance, 2004 Suttle Ct., Rio Rancho, N. Mex. 87124

[21] Appl. No.: 859,393

[22] Filed: May 5, 1986

[51] Int. Cl.[4] ..... A47B 47/02

[52] U.S. Cl. ..... 248/165; 248/460; 108/153

[58] Field of Search ..... 248/165, 150, 151, 166, 248/441.1, 441.3, 460, 168, 181, 676, 158, 453, 456, 459; 108/9, 10, 153, 155, 156

[56] References Cited

U.S. PATENT DOCUMENTS

| | | | |
|---|---|---|---|
| 2,027,609 | 1/1936 | Nelson | 108/10 |
| 3,094,802 | 6/1963 | Perry | 248/168 |
| 3,664,629 | 5/1972 | Reed | 248/441.3 |
| 4,033,537 | 7/1977 | Pridham | 248/165 |
| 4,256,300 | 3/1981 | Boucher | 248/165 |
| 4,537,392 | 8/1985 | Defibaugh | 248/168 |

FOREIGN PATENT DOCUMENTS 469261 7/1937 United Kingdom .

*Primary Examiner*—Reinaldo P. Machado
*Assistant Examiner*—Alvin Chin-Shue
*Attorney, Agent, or Firm*—Kelly, Bauersfeld & Lowry

[57] ABSTRACT

A support structure for a display stand includes a pair of oppositely facing primary coupling units attached to opposite ends of a horizontal center support bar, and four vertical display stand legs which are attached to and extend downwardly from the coupling units. Each of the coupling units includes a horizontal base tube, a pair of lateral tubes which extend parallel to one another downwardly and perpendicularly away from the base tube, and a horizontal central tube positioned between the lateral tubes, which extends away from the base tube and which is perpendicular to both the base and lateral tubes. A nut is attached to the exterior of each coupling unit tube near any open end, and an L-bolt is threaded through the nut and an adjacent aperture through the tube to extend into the interior of the tube for fastening the tube to other bars, fittings, plugs or the like.

9 Claims, 4 Drawing Figures

FIG. 1
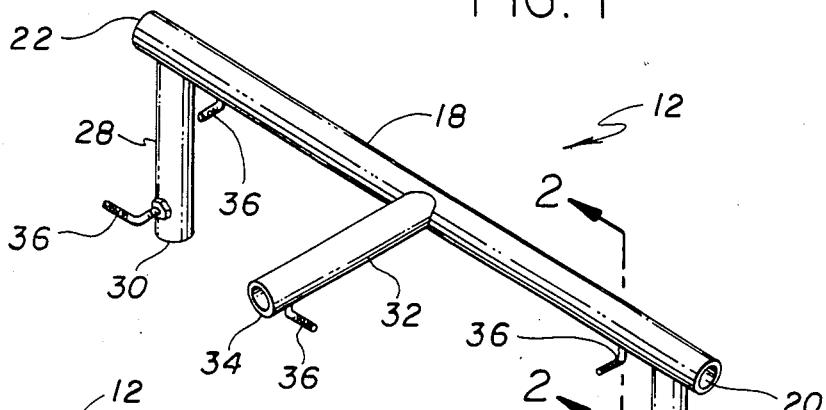
FIG. 2
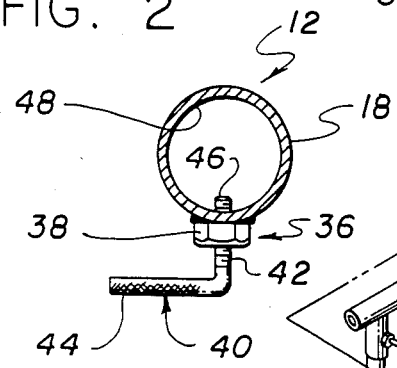
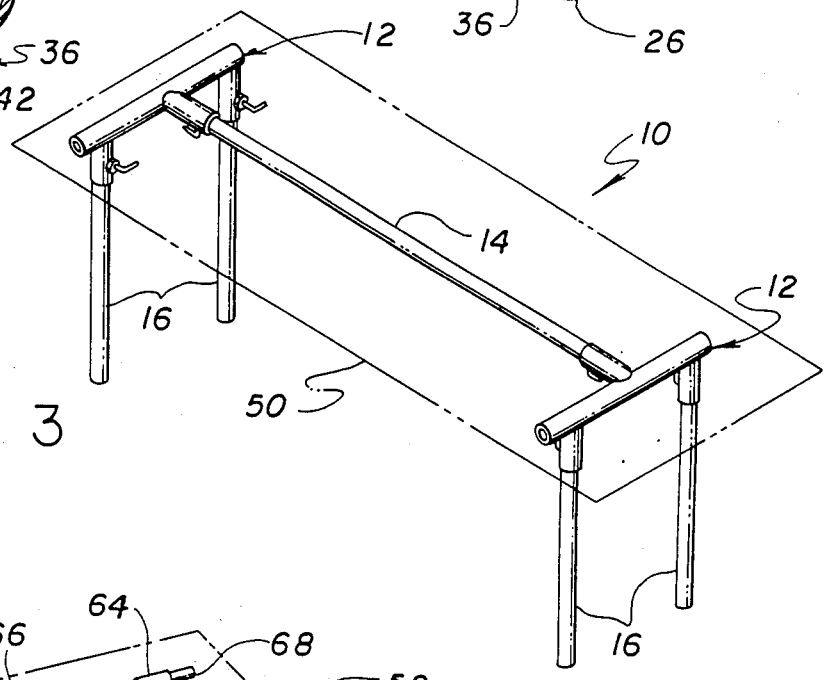
FIG. 3
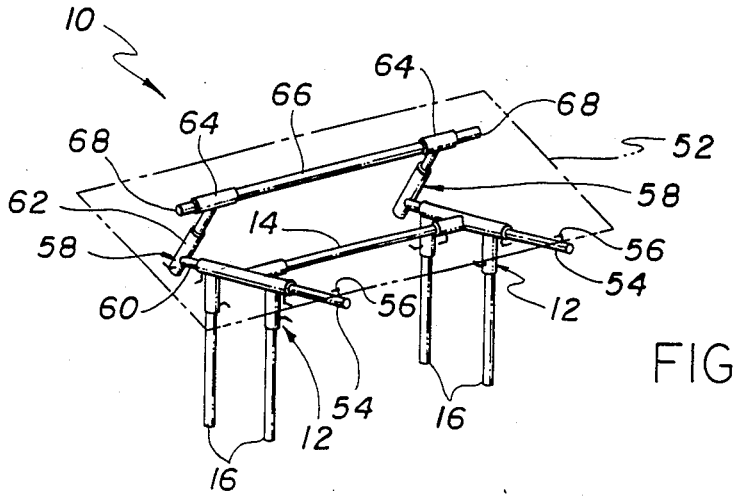
FIG. 4

DISPLAY STAND

BACKGROUND OF THE INVENTION

This invention relates generally to support structures and the like, and, more specifically, to support structures and components thereof useful for quick assembly of display stands.

For those involved in selling goods at flea markets and swap meets, there is a need for certain types of equipment which will enable the set up of what is effectively a minature store in the middle of a parking lot or field. Some of the equipment used by sellers at swamp meets and flea markets includes canopies and the associated hardware, and various sizes and shapes of display stands.

Prior display stands have included standard fold-up tables and other rigid-frame table structures which may or may not be modified. In many cases these tables have added upwardly extending supports for holding additional shelves, racks or display peg-boards. In some instances, temporary structures, i.e., sawhorses, are utilized to support one or more wooden planks to form a portable display table.

Althouth seemingly every possible modification and variation has been made to support folding tables and other rigid-frame table structures in the context of portable display stands, each of the prior systems has exhibited undesirable drawbacks. For example, display stands utilizing a base of two or more sawhorses covered by wooden planks tend to be inherently unstable and, at times, even dangerous. It has not been uncommon for such structures to collapse in use due to the weight of the goods being supported thereon, or due to an accidental impact. Moreover, such temporary and "ready-to-assemble" items have typically exhibited limited load carrying capacity, thus restricting the potential modifications which could enhance the display of a seller's goods.

Moreover, in view of the aforementioned drawbacks of temporary display stand structures, some sellers at swap meets and flea markets have opted for much stronger, permanent-like support items, such as rigid-frame tables, pick-up truck beds, and even van-like vehicles having side panels which can be opened to display the seller's goods. One obvious disadvantage of such display systems for sellers of lowcost items is the substantial capital investment required to acquire the stronger display platforms. Further, those sellers who have opted for heavy-framed support structures have found the same to be quite difficult to transport from swap meet to swap meet; an important criteria considering that many swap meets are only open a day or two a week, and all sellers of goods are required to vacate the premises at the conclusion of the specified period.

Accordingly, there has been a need for a novel support structure for display stands which is lightweight, easy to ship or transport, and may be conveniently assembled and disassembled. Such an improved support structure for display stands must be the essence of simplicity, be able to form a high strength and sturdy platform, and must be capable of multiple modifications in size and shape to accommodate the varying desires of end-users. The present invention fulfills these needs and provides other related advantages.

SUMMARY OF THE INVENTION

The present invention resides in an improved support structure for a display stand which is lightweight, can be easily assembled into a high-strength structure, and is conveniently disassembled into relatively compact components to facilitate transportation and storage of the same. The improved support structure broadly comprises a pair of oppositely facing primary coupling units attached to opposite ends of a horizontal center support bar, and four vertical display stands legs which are attached to and extend downwardly from the coupling units. Each of the coupling units includes a horizontal base tube, a pair of lateral tubes which extend parallel to one another downwardly and perpendicularly away from the base tube, and a horizontal central tube positioned between the lateral tubes, which extends away from the base tube and which is perpendicular to both the base and lateral tubes. Clamping means are provided for retaining fittings, plugs or the like inserted into any open end of the tubes, to provide the required mechanism for securing the ends of the center support bar within the central tube, and the upper ends of the display stand legs within the lateral tubes.

In a preferred form the invention, the lateral tubes, the central tube and the base tube each have a cylindrical inner surface dimensioned to receive similarly shaped ends of the display stand legs, the center support bar, and other fittings, plugs or the like to be inserted into any open end of those tubes. The clamping means is capable of adjustably engaging such fittings, plugs or the like, including the display stand legs and center support bar, to press such fittings, plugs or the like inserted through the end of any of the tubes, against an inner surface of the tubes and frictionally hold the same between the inner surface and the clamping means. More specifically, a nut is attached to the exterior of each tube near its open end(s), and an L-bolt which threadably engages the nut is passed therethrough and into the interior of the tube. The end of this L-bolt may be moved into and out of the interior as desired to sandwich an inserted fitting, plug or the like, and securely hold it within the end of the tube.

This basic support structure for a display stand can be further modified by inserting a pair of retainer fittings within respective forward open ends of the base tubes, and by inserting a corresponding pair of riser coupling units within respective rearward open ends of the base tubes. Attached to these riser coupling units are T-coupling units which each have an upper tube positioned substantially parallel to the center support bar. This upper tube is similarly dimensioned with respect to the coupling unit tubes, and holds a support bar in a raised position substantially parallel to the center support bar.

Notwithstanding the particular configuration of the support structure utilized, a display board or table top is typically placed upon and over the support structure to provide an appropriate platform for displaying a seller's goods.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of a primary coupling unit for use in constructing a display stand;

FIG. 2 is an enlarged sectional view taken generally along the line 2—2 of FIG. 1, illustrating the manner in which a nut and L-shaped bolt are attached to the exterior of a coupling unit base tube to provide means for clamping fittings, plugs or the like inserted into the open end of the base tube to retain the same therein;

FIG. 3 is a perspective view of an assembled support structure for a display stand, including two of the primary coupling units illustrated in FIGS. 1 and 2, and illustrating a table top resting atop the support structure in phantom; and FIG. 4 is another perspective view of the support structure illustrated in FIG. 3, shown as it might be modified to support an inclined display board, which is shown in phantom.

DETAILED DESCRIPTION OF THE PREFERRED EMBODIMENT

As shown in the drawings for purposes of illustration, the present invention is concerned with an improved support structure for a display stand, generally designated in the accompanying drawings by the reference number 10. This improved support structure 10 comprises a pair of oppositely facing primary coupling units 12 attached to opposite ends of a horizontal center support bar 14, and four vertical display stand legs 16 which are attached to and extend downwardly from the coupling units. The improved support structure 10 of this invention is designed to permit quick and easy assembly of several lightweight and compact components, to ultimately fashion a table or some other display structure having sufficient strength to overcome the drawbacks of prior mobile systems.

In accordance with the present invention, and as illustrated with respect to a basic preferred embodiment in FIGS. 1–3, most components of the support structure 10 are formed of lightweight aluminum tubing of essentially two standard diameters to permit some portions of the tubing to be inserted into others and secured therein. Further, several short segments of this tubing can be conveniently welded to others to form rigid units which enhance the strength and durability of the support structure as a whole. More particularly, and as illustrated best in FIGS. 1 and 2, each primary coupling unit 12 includes a horizontal base tube 18 having open forward and rearward ends 20 and 22. Welded to the base tube 18 near the open forward end 20 is a forward lateral tube 24 which extends perpendicularly away from the base tube and includes a lower open end 26. A rearward lateral tube 28 is similarly welded to the base tube 18 to extend perpendicularly away therefrom and parallel to the forward lateral tube 24. This rearward lateral tube also has a lower open end 30. A central tube 32 is further welded to the base tube 18 at a point generally bisecting the length of the base tube. This central tube 32 is positioned to extend perpendicularly away from the base tube 18, as well as the parallel lateral tubes 24 and 28, and it also has an open end 34 opposite its point of attachement to the base tube 18.

When the primary coupling unit 12 is constructed as described above with similarly sized tubing, a rigid unit is formed which can accept other lightweight tubing of a smaller diameter and hold the same in a predetermined spaced relationship. Moreover, as will become apparent from the following description, the primary coupling unit 12 permits many different types of variations and modifications to be made to the support structure, increasing its utility and versatility.

To retain bars, fittings, plugs or the like inserted into any of the open ends 20, 22, 26, 30 or 34, an adjustable locking mechanism 36 is provided near each open end. As best illustrated in FIG. 2, a relatively small hole is drilled through each tube near the open end thereof, and a nut 38 is welded to align its aperture with the hole drilled through the tube. An L-bolt 40, having a threaded portion 42 and a bolt arm 44, is threaded through the nut 38 so that a tip 46 of the threaded portion 42 extends into the interior of the adjacent tube. Typically when assembling the support structure 10, the L-bolt 40 would be rotated in a counter-clockwise direction to withdrawn the tip 46 from the interior of each adjacent tube. After a bar, fitting, plug or the like had been inserted into the open end of the adjacent tube, the L-bolt 40 would then be rotated in a clockwise direction to move the tip 46 of the threaded portion 42 into contact with the bar, fitting, plug or the like, and press the same against the cylindrical inner surface 48 of the tube to frictionally clamp the inserted bar, fitting, plug or the like between the L-bolt and the tube's inner surface.

The center support bar 14 and the display stand legs 16 preferably all have an outer diameter slightly smaller than the diameter of the cylindrical inner surface 48 of the primary coupling unit. Such dimensioning of the center support bar 14, the display stand legs 16, and the tubing comprising the coupling units 12 facilitates the easy assembly and disassembly of the support structure 10, while simultaneously permitting the construction of a very high-strength and stable base for various types of display stands.

To assemble the basic support structure 10 illustrated in FIG. 3, two primary coupling units 12 would be situated with their lateral tubes 24 and 28 facing generally downwardly, and the coupling units would further be oppositely situated so that their central tubes 32 would be facing one another. Before proceeding further, the user would usually ensure that none of the tips 46 of the L-bolts 40 would be extending into the interior of any of the tubes. Once this has been completed, the ends of the center support bar 14 would be inserted into respective ones of the central tubes 32 of the oppositely facing primary coupling units 12. After such insertion, the adjustable locking mechanism 36 associated with each of the central tubes 32 would be tightened by grasping the bolt arm 44 and rotating the L-bolt 40 in a clockwise direction to clamp the ends of the center support bar between the tip 46 and the cylindrical inner surface 48 of each central tube. Next, the display stand legs would have a upper end similarly inserted through the lower open ends 26 and 30 of the forward and rearward lateral tubes 24 and 28, respectively, and then those legs would be clamped therein by the adjustable locking mechanisms 36 in a manner idential to that described in connection with the center support bar 14.

After such simple assembly, a high-strength and durable support structure 10 is formed, over which a table top 50 can be placed. For puposes of illustration, the table top 50 is illustrated in phantom in FIG. 3.

This basic support structure 10 can be further modified in a variety of ways as desired by the end user, virtually without restriction. For example, as illustrated in FIG. 4, when an inclined display board 52 is desired to be supported by the support structure 10 rather than a table top, the open forward and rearward ends 20 and 22 of the horizontal base tube 18 can be used to further support other bars, fittings, plugs or the like, to fashion suitable modifications. In the case of modifying the support structure 10 for the inclined display board 52, retainer fittings 54 providing an abutment 56 for the lower forward end of the display board 52 would be inserted through the open forward ends 20 of the base tubes 18, and secured therein by the associated adjustable locking mechanisms 36. A riser coupling unit 58, having a plug portion 60 and a tubular riser 62, would further be attached to the primary coupling units 12 by inserting the plug portion into the open rearward ends 22 of the base tubes 18 and securing it therein by the adjustable locking mechanisms 36. A T-coupling unit 64 could then be placed in and supported by the tubular riser 62 in a similar fashion, which T-coupling unit could support an upper support bar 66 and a pair of end plugs 68. This upper support bar 66, the end plugs 68 and a portion of the T-coupling 64, unit would all combine to provide an upper surface upon which a portion of the display board 52 could rest, and by the construction described above, the elevation of the T-coupling unit and its attached components could be modified to vary the angle of inclination of the display board.

From the foregoing, it is evident that the support structure 10 can be modified into various configurations to meet the widely different needs of various end users. It should be apparent, however, that notwithstanding the various possible modifications, the basic configuration of the support structure 10 can be characterized as the essence of simplicity, affording the user simple, easy steps for assembly and disassembly of the same, yet it is lightweight, durable and far stronger than other collapsible and adjustable support structures.

Although a particular embodiment and a modification thereof have been described in detail for purposes of illustration, various modifications may be made without departing from the spirit and scope of the invention. Accordingly, the invention is not to be limited, except as by the appended claims.

I claim:

1. A support structure for a display stand, comprising:

a pair of oppositely facing primary coupling units, each of said coupling units including a base tube having an open forward end and an open rearward end, the base tube further having attached thereto near the opposite forward and rearward ends at least a pair of spaced lateral tubes which extend parallel to one another perpendicularly away from said base tube, a central tube attached to and extending from said base tube between said pair of lateral tubes, said central tube extending perpendicular to both said base tube and said lateral tubes, and means for clamping fittings, plugs or the like inserted into any open end of said tubes to retain those fittings, plugs or the like therein, said clamping means including means for adjustably engaging the fittings, plugs or the like inserted into any open end of said tubes, to press the inserted fittings, plugs or the like against an inner surface of said tubes and frictionally hold the inserted fittings, plugs or the like between said inner surface and said engaging means;

a center support bar extending between said coupling units, said center support bar being dimensioned so that its ends can be received within, respectively, said central tube of said coupling units;

at least four display stand legs, each of said legs being dimensioned so that one end thereof can be received within, respectively, said lateral tubes of said coupling units, said oppositely facing primary coupling units being positioned with respect to each other to align all of said legs in a parallel manner downwardly for contact with the ground;

a pair of retainer fittings positioned within and extending from the respective forward ends of said base tubes;

a corresponding pair of riser coupling units positioned within and extending from the respective rearward open ends of said base tubes;

a pair of T-coupling units positioned within and extending generally upwardly from respective ones of said riser coupling units, each of said T-coupling units having an upper tube positioned substantially parallel to said center support bar; and an upper support bar extending between said upper tubes substantially parallel to said center support bar, said upper support bar being dimensioned so that its ends can be received within, respectively, said upper tubes.

2. A support structure for a display stand as set forth in claim 1, wherein each of said upper tubes has a cylindrical inner surface dimensioned to receive similarly shaped ends of said upper support bar.

3. A method of constructing a display stand, the steps comprising:

providing a coupling unit including:

a base tube having an open forward end and an open rearward end, a pair of lateral tubes attached, respectively, near the opposite forward and rearward ends of said base tube and extending parallel to one another perpendicularly away from said base tube, a central tube attached to and extending from said base tube between said pair of lateral tubes, said central tube extending perpendicular to both said base tube and said pair of lateral tubes, and means for clamping fittings, plugs or the like inserted into any open end of said tubes to retain those fittings, plugs or the like therein, said clamping means including means for adjustably engaging the fittings, plugs or the like inserted into any open end of said tubes, to press the inserted fittings, plugs or the like against an inner surface of said tubes and frictionally hold the inserted fittings, plugs or the like between said inner surface and said engaging means;

situating two coupling units so the lateral tubes face generally downwardly and the central tubes of each coupling unit are oriented to extend generally toward the central tube of the opposite coupling unit;

inserting ends of a center support bar into respective ones of the central tubes and securing the inserted ends of the center support bar therein with the engaging means;

inserting an upper end of a display stand leg through an open end of each of the lateral tubes to support the center support bar and attached coupling units above the ground, and securing these legs within the lateral tubes using the engaging means, the display stand legs, coupling units and center support bar forming the basic support structure for the display stand;

positioning a pair of retainer fittings within and extending from the respective forward ends of the base tubes;

positioning a corresponding pair of riser coupling units within and extending from the respective rearward ends of the base tubes;

positioning a pair of T-coupling units within and extending generally upwardly from respective ones of the riser coupling units, each of the T-coupling units having an upper tube positioned substantially parallel to the center support bar;

positioning an upper support bar to extend between the upper tubes substantially parallel to the center support bar; and placing a display surface over the support structure and securing it thereto.

4. A support structure for a display stand, comprising:

a pair of oppositely facing primary coupling units, having open ends for receiving fittings, plugs or the like therein, and each of said coupling units including a base tube having attached thereto near opposite ends of said base tube at least a pair of lateral tubes which extend paralalel to one another perpendicularly away from said base tube wherein the longitudinal axes of said lateral tubes substantially intersect the longitudinal axis of said base tube, a central tube attached to and extending from each of said base tubes between said pair of lateral tubes wherein the longitudinal axis of said central tube substantially intersects the longitudinal axis of said base tube, said central tube extending perpendicular to both said base tube and said lateral tubes, and means for clamping fittings, plugs or the like inserted into any open end of said tubes to retain those fittings, plugs or the like therein;

a center support bar extending between said coupling units, said center support bar being dimensioned so that its ends can be received within, respectively, said central tubes of said coupling units; and at least four display stand legs, each of said legs being dimensioned so that one thereof can be received within, respectively, said lateral tubes of said coupling units, said oppositely facing primary coupling units being positioned with respect to each other to align all of said legs in a parallel manner downwardly for contact with the ground.

5. A support structure for a display stand as set forth in claim 4, wherein said clamping means includes means for adjustably engaging the fittings, plugs or the like inserted into any open end of said tubes, to press the inserted fittings, plugs or the like against an inner surface of said tubes and frictionally hold the inserted fittings, plugs or the like between said inner surface and said engaging means.

6. A support structure for a display stand as set forth in claim 5, wherein said engaging means includes a nut attached to the exterior of each said tube near each said open end, and a L-bolt threadably engaging said nut.

7. A support structure for a display stand as set forth in claim 5, wherein each of said lateral tubes has a cylindrical inner surface dimensioned to receive a similarly shaped end of said display stand legs.

8. A support structure for a display stand as set forth in claim 5, wherein each of said central tubes has a cylindrical inner surface dimensioned to receive a similarly shaped end of said center support bar.

9. A support structure for a display stand as set forth in claim 5, wherein the ends of said base tube are open to receive further fittings, plugs or the like.

* * * * *

UNITED STATES PATENT AND TRADEMARK OFFICE

CERTIFICATE OF CORRECTION

PATENT NO. : 4,691,885

DATED : September 8, 1987

INVENTOR(S) : George F. Lawrance

It is certified that error appears in the above-identified patent and that said Letters Patent is hereby corrected as shown below:

In Column 1, line 14, delete the word "swamp" and insert therefor--swap--.

In Column 2, line 11, delete the word "stands" and insert therefor--stand--.

In Column 4, line 27, delete the word "surface" and insert therefor--surfaces--.

In Column 4, line 53, delete the word "a" and insert therefor--an--.

In Column 7, line 17, delete claim 4 and insert therefor--
A support structure for a display stand, comprising:
a pair of oppositely facing primary coupling units, each of said coupling units including a base tube having open ends for receiving fittings, plugs or the like therein, and having attached thereto near opposite ends of said base tube at least a pair of lateral tubes which extend parallel to one another perpendicularly away from said base tube wherein the longitudinal axes of said lateral tubes substantially intersect the longitudinal axis of said base tube, a central tube attached to and extending from each of said base tubes between said pair of lateral tubes wherein the longitudinal axis of said central tube substantially intersects the longitudinal axis of said base tube, said central tube extending perpendicular to both said base tube and said lateral tubes, and means for clamping fittings, plugs or the like inserted into any open end of said tubes to retain those fittings, plugs or the like therein;
a center support bar extending between said coupling units, said center support bar being dimensioned so that its ends can be received within, respectively, said central tubes of said coupling units; and

UNITED STATES PATENT AND TRADEMARK OFFICE

CERTIFICATE OF CORRECTION

PATENT NO. : 4,691,885

DATED : September 8, 1987

INVENTOR(S) : George F. Lawrance

It is certified that error appears in the above-identified patent and that said Letters Patent is hereby corrected as shown below:

at least four display stand legs, each of said legs being dimensioned so that one end thereof can be received within, respectively, said lateral tubes of said coupling units, said oppositely facing primary coupling units being positioned with respect to each other to align all of said legs in a parallel manner downwardly for contact with the ground.

In Column 8, line 23, delete the word "a" and insert therefor--an--.

Signed and Sealed this

Second Day of February, 1988

*Attest:*

DONALD J. QUIGG

*Attesting Officer*

*Commissioner of Patents and Trademarks*